US008985016B2

(12) United States Patent
Schwipps

(10) Patent No.: US 8,985,016 B2
(45) Date of Patent: Mar. 24, 2015

(54) PRINTING PLATE SLEEVE LOADING AND UNLOADING APPARATUS AND METHOD

(75) Inventor: Torsten E. Schwipps, Oelixdorf (DE)

(73) Assignee: Esko-Graphics Imaging, GmbH, Itzehoe (DE)

( * ) Notice: Subject to any disclaimer, the term of this patent is extended or adjusted under 35 U.S.C. 154(b) by 418 days.

(21) Appl. No.: 13/294,892

(22) Filed: Nov. 11, 2011

(65) Prior Publication Data

US 2012/0132094 A1 May 31, 2012

Related U.S. Application Data

(60) Provisional application No. 61/417,248, filed on Nov. 25, 2010.

(51) Int. Cl.

| | |
|---|---|
| ***B41F 5/00*** | (2006.01) |
| ***B41F 13/10*** | (2006.01) |
| ***B41F 27/10*** | (2006.01) |
| ***B41C 1/10*** | (2006.01) |

(52) U.S. Cl.

CPC ..... *B41F 27/105* (2013.01); *B41C 1/1083* (2013.01); *B41P 2227/20* (2013.01); *B41P 2227/21* (2013.01)

USPC ..... 101/216; 101/375

(58) Field of Classification Search

CPC ..... B41F 13/20; B41F 27/105

USPC ..... 101/375, 376, 378, 383, 415.1, 216; 492/21

See application file for complete search history.

(56) References Cited

U.S. PATENT DOCUMENTS

| | | | | |
|---|---|---|---|---|
| 2,675,605 | A * | 4/1954 | Thomas | 492/19 |
| 3,145,451 | A * | 8/1964 | Christensen | 492/21 |
| 3,761,008 | A * | 9/1973 | Goulder | 279/2.03 |
| 3,783,780 | A * | 1/1974 | Saueressig | 101/153 |
| 4,913,048 | A * | 4/1990 | Tittgemeyer | 101/141 |
| 5,275,105 | A * | 1/1994 | Schweizer et al. | 101/477 |
| 6,546,867 | B1 * | 4/2003 | Franklin et al. | 101/378 |
| 2011/0098166 | A1 * | 4/2011 | Kerschbaumer et al. | 492/21 |

FOREIGN PATENT DOCUMENTS

| | | |
|---|---|---|
| FR | 1207509 | 2/1960 |
| FR | 2094373 | 2/1972 |
| GB | 735932 | 8/1955 |

OTHER PUBLICATIONS

Extended European Search Report on EPO Application No. 11190759.8 mailed Mar. 19, 2012.

* cited by examiner

*Primary Examiner* — Ren Yan
(74) *Attorney, Agent, or Firm* — Dov Rosenfeld; Inventek

(57) ABSTRACT

A device and method are described for the easy and rapid loading and unloading of flexographic sleeves from flexographic processing machines. The device includes internal chucks that hold on to the end of a sleeve or sleeve adapter. The chucks are rotatably mounted within a flexographic processing machine to permit sleeve processing. In addition, the chucks may move to accommodate a large range of sleeve or adapter diameters and lengths. The method permits the loading and unloading of sleeves with a minimum amount of sleeve handling and without additional end pieces or adapters.

23 Claims, 10 Drawing Sheets

PRINTING PLATE SLEEVE LOADING AND UNLOADING APPARATUS AND METHOD

RELATED APPLICATIONS

The present application claims priority of U.S. Provisional Patent Application No. 61/417,248 filed 25 Nov. 2010 to inventor Schwipps, titled PRINTING PLATE SLEEVE LOADING AND UNLOADING APPARATUS AND METHOD, the contents of which are incorporated herein by reference in their entirety.

FIELD OF THE INVENTION

The present disclosure is generally related to printing devices, and more specifically to the handling of printing sleeves and plates.

BACKGROUND

Flexographic printing plates may be formed from a flexographic material having a photosensitive layer. In a computer-to-plate operation, an image to be printed exposes an ablatable masking material on a photopolymer plate to form a mask. The resulting mask is then uniformly exposed to ultraviolet (UV) radiation, and processed to form raised portions for use in printing. Thus, for certain flexographic materials, processing includes curing an exposed material with UV radiation in a UV exposure unit.

It is common to use cylindrical sleeves of flexographic plate material to form printing plates. After exposure to imaging data, the sleeves are transferred from the imager to a UV exposure unit and other processing machines. In order to match diameters the sleeve diameter to the size of specific machines, it is also common to place the sleeves on the outer surface of sturdy cylindrical sleeve adapters for imaging and and/or UV exposure.

For purposes of this description, the sleeve or sleeve adapter is a hollow cylinder. One technique for holding cylindrical sleeves and/or adapters is by using conical end pieces (chucks) and the apex of such conical chucks into each hollow end of the cylinder, and supporting the base of each conical end. The cylinder is held by friction. In a UV exposure unit, for example, one or both end pieces are then rotated while the sleeve is exposed to UV radiation from lamps. The lamps may either extend the length of the sleeve or are shorter than the length of the sleeve and move longitudinally as the sleeve is rotated.

There may be several problems with using such prior art UV exposure units with such conical chucks that are related to the alignment of the sleeve, access to the sleeve, and ability to expose different sized sleeves.

For accurate rotation, the axis of the cylinder should coincide with the two apexes of the chucks, i.e., with the axis of rotation. If each conical end piece easily slides into the respective end of the sleeve or sleeve adapter, then the sleeve will be aligned with the rotation axis. However, the pieces and sleeve or adapter do not always slide easily in practice, resulting in the axis of the cylindrical sleeve not being co-linear with the conical end pieces. As a result, the sleeve may not rotate properly about the sleeve axis.

Other problems with some prior art mechanisms relate to the fact that the diameters of different sleeves may vary.

Furthermore, access to the entire length of the sleeve may also be important, e.g., in order to UV expose all the way to the end of the sleeve. Since the ends are supported by conical end pieces having a base larger in diameter than the sleeve, for relatively small diameters it may not be possible to place a lamp near the sleeve ends. This can be overcome my having many conical chucks of different diameter to accommodate many different sleeve diameters. However, such an approach may not be desirable.

BRIEF DESCRIPTION OF THE DRAWINGS

FIG. 2 shows the device in a slightly closed configuration and where FIGS. 3 and 4 shows the device in a more closed configuration;

FIGS. 7 and 8 illustrate sequential steps of a user placing one end of a sleeve into a first chuck, FIGS. 9, 10, 11, and 12 illustrate sequential steps of a user placing and securing a second end of a sleeve into a second chuck, FIGS. 13 and 14 illustrate sequential steps of a user securing the sleeve into the first chuck; and FIG. 15 is a image of a sleeve mounted into the flexographic processing machine utilizing the first and second sleeve handling devices;

Figure 1A:
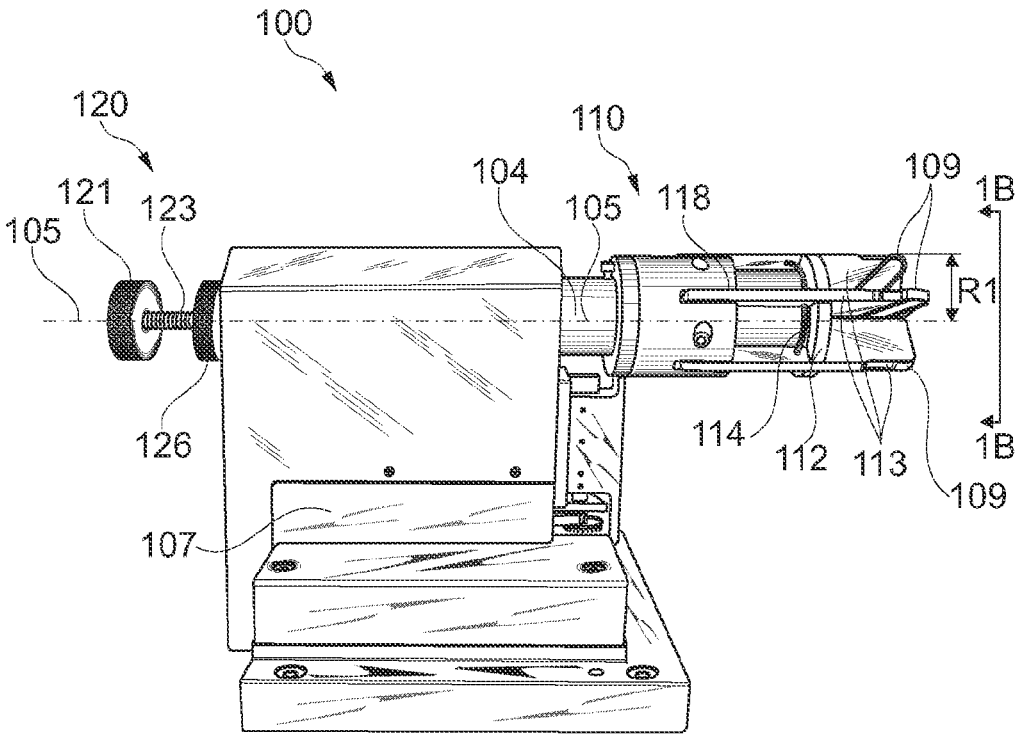
FIG. 1A shows a side view image of an embodiment of a support device for a cylindrical printing sleeve or printing sleeve adapter.

Reference symbols are used in the drawings to indicate certain components, aspects or features shown therein, with reference symbols common to more than one drawing indicating like components, aspects or features shown therein.

DETAILED DESCRIPTION OF EXAMPLE EMBODIMENTS

Brief Overview

It may be advantageous to have an apparatus for handling sleeves or sleeve adapters that can align a sleeve or sleeve adapter relative to a rotation axis. It may also be advantageous to have a mechanism for handling sleeves or sleeve adapters that can expose the entire surface of the sleeve. It may also be advantageous to have a mechanism for handling sleeves or sleeve adapters that is usable with a variety of sleeve and/or sleeve adapter diameters. It may also be advantageous to have a mechanism for handling sleeves or sleeve adapters that is compatible with current flexographic sleeve processing machines. It may also be advantageous to have a mechanism for handling sleeves or sleeve adapters that is relatively easy to use. Some embodiments of the present invention may have one or more of these properties, although the inventor is not insisting that any of these advantages is or are provided by any embodiment of the invention. Rather, the invention is as described by the claims and their legal equivalents.

Embodiments of the present invention include a pair of chucks for holding the ends of a cylindrical sleeve or sleeve adapter from the interior surface of the hollow ends of the cylinder.

In one embodiment, an apparatus for mounting a hollow cylindrical printing sleeve or printing sleeve adapter along the axis in a housing is provided, where the cylindrical printing sleeve or printing sleeve adapter has a first hollow end and a second hollow end. The apparatus includes a first device and a second device. The first device includes a first chuck attached to the housing, where the first chuck has a first plurality of jaws each having a grip end, and where the grip ends of the first plurality of jaws can move radially towards or away from the axis. The second device includes a second chuck attached to the housing, where the second chuck has a second plurality of jaws each having a grip end, and where the grip ends of the second plurality of jaws can move radially towards or away from the axis. The first plurality of jaws and the second plurality of jaws are spaced along the axis to accept the first hollow end and the second hollow end, respectively. While the first plurality of jaws and the second plurality of jaws are in the first and second hollow ends, the grip ends of the first plurality of jaws and the grip ends of the second plurality can be caused to extend radially away from the axis to grip, by friction, the first and the second hollow ends to mount the object within the housing.

In another embodiment, an apparatus for mounting a hollow cylindrical printing sleeve or printing sleeve adapter having a hollow cylindrical end in a housing is provided. The apparatus includes a chuck including a chuck body and a plurality of jaws each having a grip end and hinge end. The chuck body is attached to a shaft that is rotatably attached to the housing about an axis, and the each of the plurality of jaws is hinged at or near the hinge end to the chuck body to cause the grip ends to move radially in a plane perpendicular to said axis to accommodate different diameter hollow cylindrical printing sleeves or printing sleeve adapters. The apparatus also includes a first actuator operably connected to the plurality of jaws. The actuator includes a threaded rod that can move a cam that is in contact with the plurality of jaws, the thread coupled to one or more matching threaded portions in the shaft such that when the threaded rod is rotated relative to the shaft, the rod moves within the shaft to cause the cam to move the grip ends towards or away from the axis. The grip end may thus be caused to extend radially away from the axis to grip, by friction, the hollow end to mount the printing sleeve or printing sleeve adapter within the housing.

In yet another embodiment, a method of handling a flexographic sleeve, or sleeve on an adapter, having an axis and a length within a flexographic processing machine, is provided. The method includes restraining the sleeve by: placing a first end of the sleeve, or the adapter supporting the sleeve, over a first internal chuck; expanding the first internal chuck to restrain the sleeve, or the adapter supporting the sleeve; placing a second end of the sleeve, or the adapter supporting the sleeve, over a second internal chuck; and expanding the second internal chuck to restrain the second end of the sleeve, or the adapter supporting the sleeve. Each of the first and second internal chucks includes a plurality of fingers each having a grip end. Expanding each of the first and second internal chucks is by moving the grip ends radially out away from the axis.

Particular embodiments may provide all, some, or none of these aspects, features, or advantages. Particular embodiments may provide one or more other aspects, features, or advantages, one or more of which may be readily apparent to a person skilled in the art from the figures, descriptions, and claims herein.

Some Example Embodiments

FIG. 1A shows side view image of an embodiment of a cylindrical printing sleeve or printing sleeve adapter support device 100. Device 100 includes a base body 107 supporting a chuck 110 comprising a chuck body 118 attached to a shaft 104, the chuck body 119 having a jaw alignment portion 112, a plurality of jaws 113 each having a grip end 109 and a hinge end, one or more of springs 114 attached to the jaws, and an actuator 120 having a knob 121, a rod 123, and an interlock 126 to restrain motion of the chuck. The chuck body 118 and shaft 104 are rotatably attached to the housing so that they rotate about axis 104. When the interlock 126 is used, the rod 123 and shaft 104 rotate together about the housing. As shown in FIG. 1A, chuck 110 and actuator 120 are generally aligned along an axis 105, which is also the axis of the shaft 104. As described subsequently, when rod 123 is moved along its length along axis 105 relative to the shaft 104, jaws 113 rotate about respective jaw axes of rotation near their respective hinge ends so that their respective grip ends 109 move radially towards or away from the axis. In certain embodiments, the movement of jaws 113 permit chuck 110 to be used as an internal chuck that may be used to grip and therefore support the inner cylindrical surface of a flexographic sleeve or sleeve adapter during exposure to UV radiation and for other purposes.

Figure 1B:
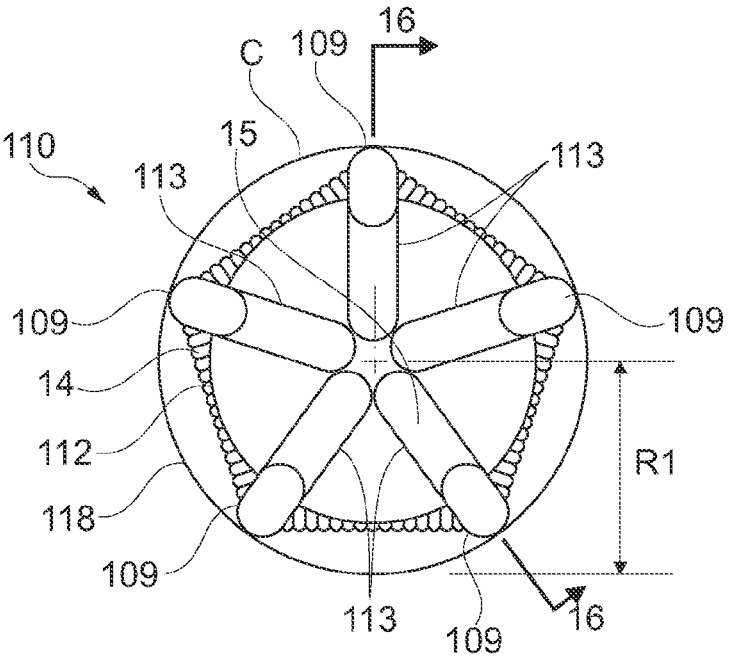
FIG. 1B shows a end view 1B-1B of FIG. 1A.

FIG. 1B illustrates one embodiment of device 100 that includes five jaws 113 symmetrically distributed about axis 105. Chuck 110 as shown in FIGS. 1A and 1B is in an open configuration, with each grip end 109 of the plurality of jaws 113 in a position near axis 105 and arranged to fit within a circle C, formed by an outer surface of chuck body 118, having a radius R1 about axis 105. Different embodiments can have a different number of jaws.

Figure 2:
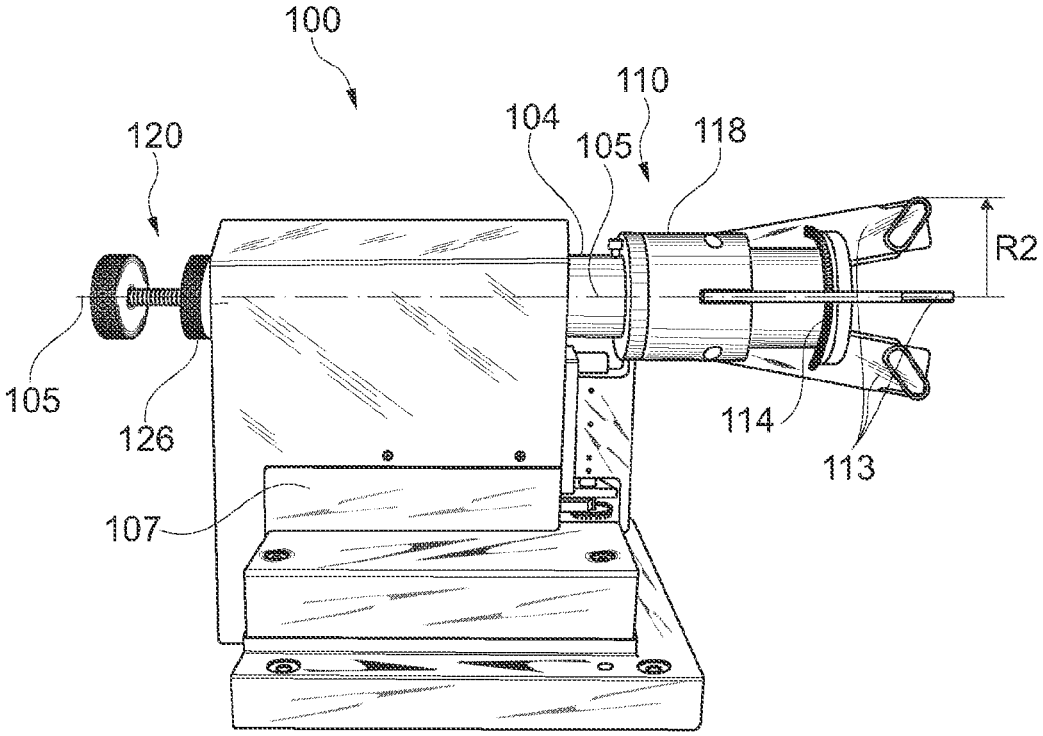
FIGS. 2 to 4 show side view images of the device of FIG. 1 in different configurations, where
Figure 3:
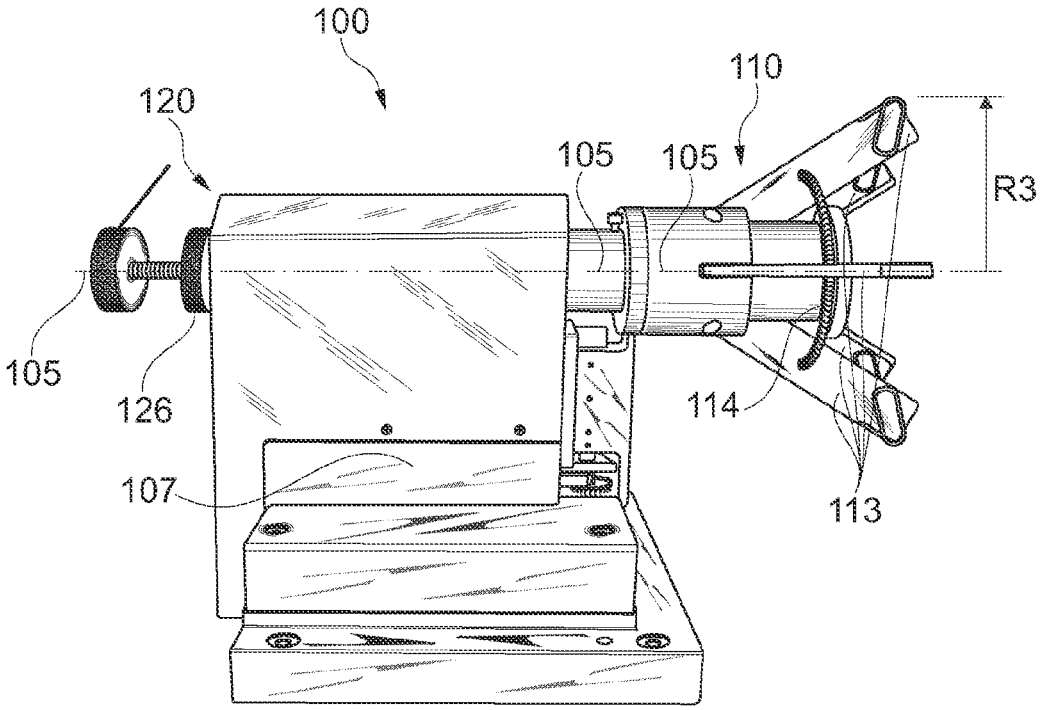
Figure 4:
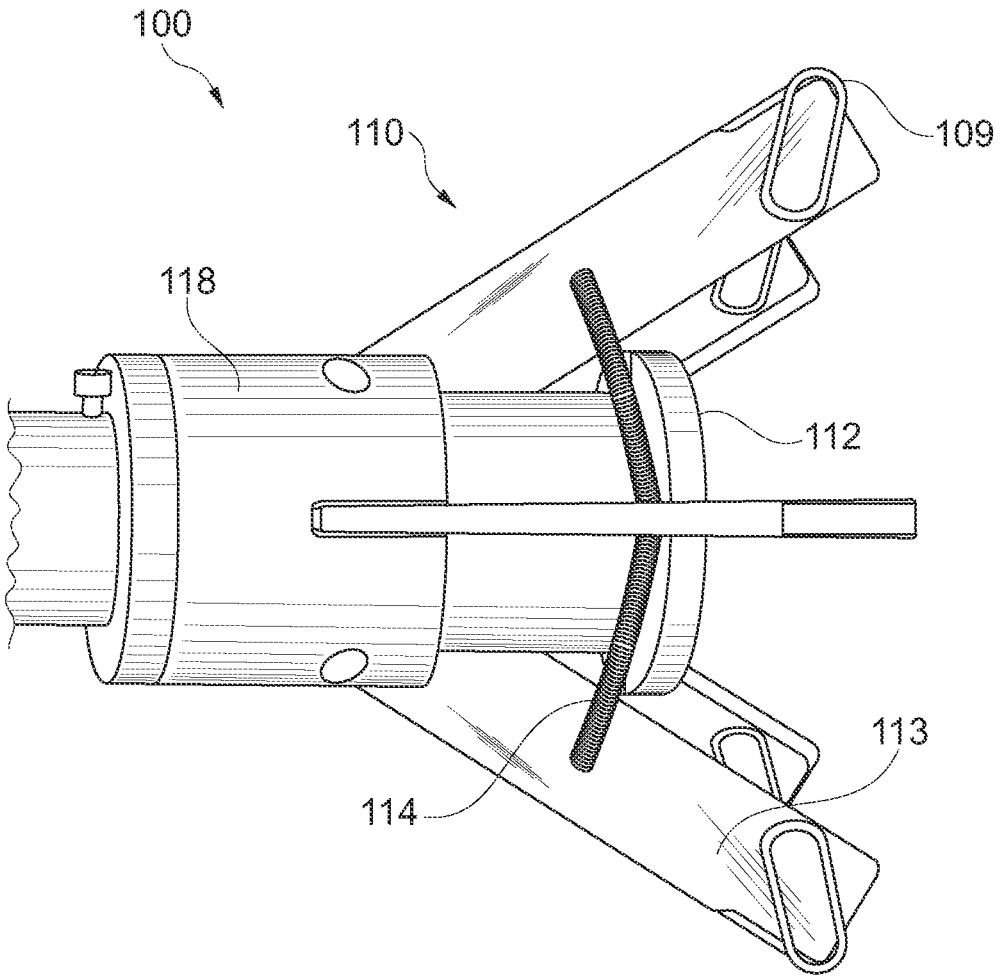

FIGS. 2 to 4 show side view images of device 100 with chuck 110 in different configurations. FIG. 2 shows the chuck in a slightly closed configuration, and FIGS. 3 and 4 shows the chuck in a more open configurations, i.e., with the grip ends 109 of the plurality of jaws 113 more expanded outwards in the radial direction than in FIG. 2. Specifically, in FIG. 2 the grip ends 109 of the plurality of jaws 113 are radially expanded outwards from axis 105 to a radial distance of R2, R2>R1, and in FIG. 3 the grip ends 109 of the plurality of jaws 113 are radially expanded outwards from axis 105 to a radial distance of R3, R3>R2.

Figure 5A:
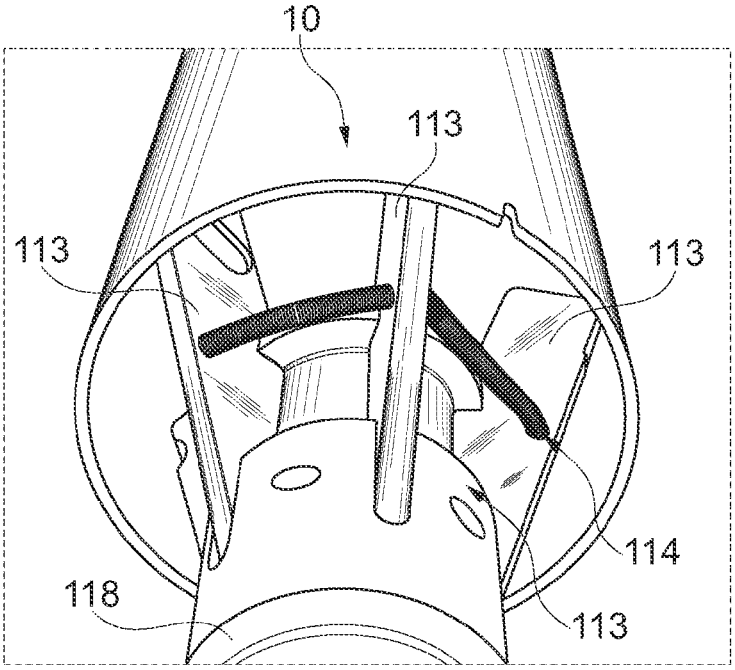
FIG. 5A shows a top perspective image showing the device of FIG. 1 in a closed configuration as clamping a sleeve.
Figure 5B:
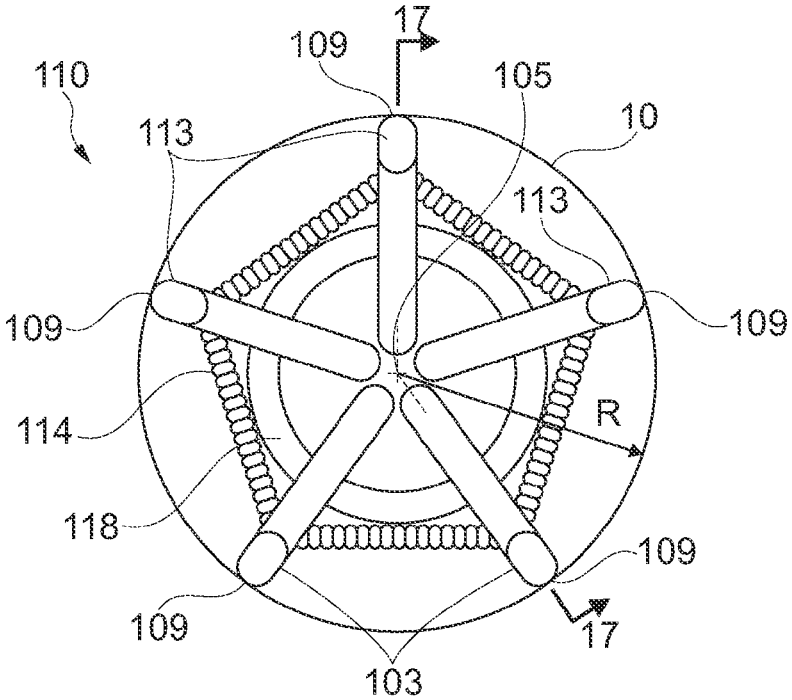
FIG. 5B shows a end view showing the device of FIG. 1 in a closed configuration.

FIG. 5A shows a top perspective image and FIG. 5B shows an end view showing chuck 110 of FIG. 1 in a closed configuration as having the grip ends 109 applying force, and thus restraining by friction the inner surface of a specific sleeve or sleeve adapter 10 having has an inner radius of R, which is greater than R1. Actuator 120 has been moved to expand the grip ends 109 applying of jaws 113 outwards such that grip ends 109 are in contact with the inner surface of the sleeve or sleeve adapter.

Device 100 is able to accommodate sleeves or sleeve adapters 10 having a large range of radii, each radius greater than R1.

In different embodiments, rod 123 may be connected to jaws 113 using linkages, springs, cams, rods, and/or threaded components (not shown in FIG. 1A) and which may be manipulated to cause the grip ends 109 of the jaws to move away from and towards axis 105. In one embodiment, the rod 123 is threaded at least in parts, and is inserted into part of shaft 104 via threaded portions. The shaft can move a cam. Rotating the rod relative to the shaft 104 causes the rod to move longitudinally relative to the shaft 104, which in turn causes the cam to move and such motion causes the grip ends of the jaws to open and close.

Thus, for example, the movement of jaws 113 described with reference to FIGS. 1 to 5B by rotating or pushing the actuator, depending on the particular mechanism within base body 107 in the particular embodiment. In certain embodiments, the action of spring 114 is not required to return the grip ends 109 of the jaws 113 towards axis 105, and the spring may be an optional component. The movement of actuator 120 may be performed manually or, alternatively, automated by being driven by a motor. In certain embodiments, chuck 110 is free to rotate, or may be driven to rotate, about axis 105. In certain other embodiments, chuck 110 does not rotate about axis 105.

In the embodiment in rod 123 has an external thread, an interlock 126 is used to lock the rod relative to the shaft. In one embodiment, the interlock 126 has a thread that matched the thread on rod 123. To lock, the interlock 126 is screwed against the shaft (104) such that the rod 123 and the shaft 104 are connected and rotating the rod 123 also causes the shaft 104 to rotate. This also fixes the actuator, and thus plurality of jaws 113, relative to chuck body 118. In one embodiment, the external thread in rod 123 on which the interlock 126 operates is the same external thread that is matched with threads in shaft 104. In some such embodiments, the thread in the portion of rod 123 on which the interlock 126 operates is different that then thread that is matched with threads in shaft 104.

In different embodiments, interlock 126 may include, for example, and without limitation, a ferrule (not shown) that crimps down on rod 123 when the interlock is rotated, fixing the actuator, and thus plurality of jaws 113, relative to chuck body 118.

As illustrated in FIGS. 1 to 5B, actuator 120 may be moved by a user to cause the grip ends 109 of jaws 113 to move radially towards or away from central axis 105. Thus, for example and described subsequently, a user may place an inner surface a cylindrical sleeve or sleeve adapter, the inner surface being cylindrical having a radius of R (where R>R1) along axis 105 and over the plurality of jaws 113, and then may manipulate actuator 120, causing the grip ends 109 of jaws 113 to expand radially outwards from axis 105 towards radius R. As shown in FIG. 4, the ends of jaws 113, in one embodiment, have grip ends 109 that each includes a rubber tip for contact with the inner surface of a cylindrical tube.

Other embodiments may have a fewer number or greater number of jaws 113. Thus, for example, and without limitation, alternative embodiments of device 100 may have 3, 4, 6, 7, or 8 jaws.

In an alternative embodiment, chuck 110 is rotatably mounted in base body 107 such that the chuck can rotate about axis 105. In another alternative embodiment, a rotatably mounted chuck 110 is operably connected to a motor that rotates the chuck.

Figure 16:
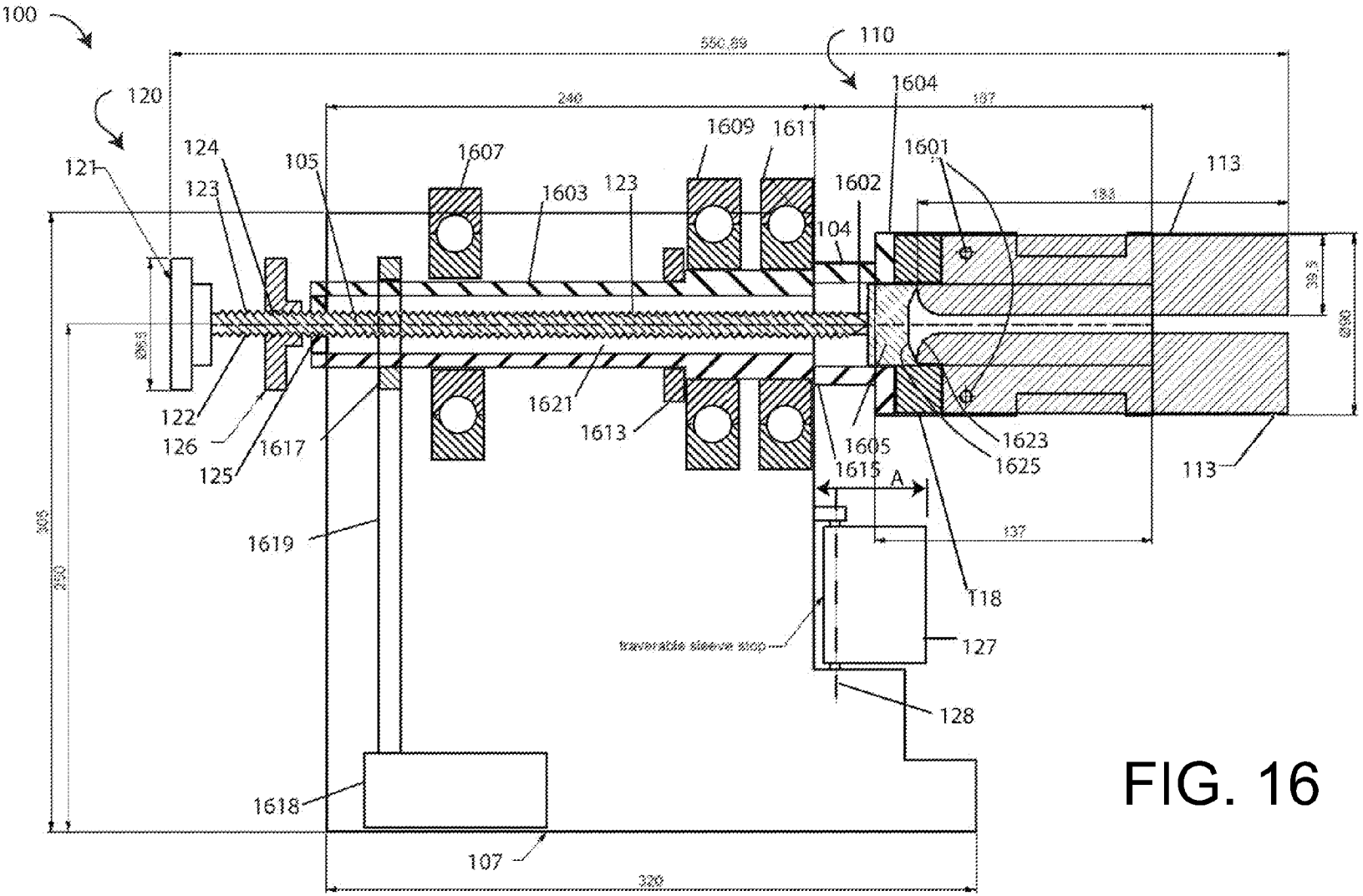
FIG. 16 shows a simplified sectional view 16-16 of FIG. 1B.
Figure 17:
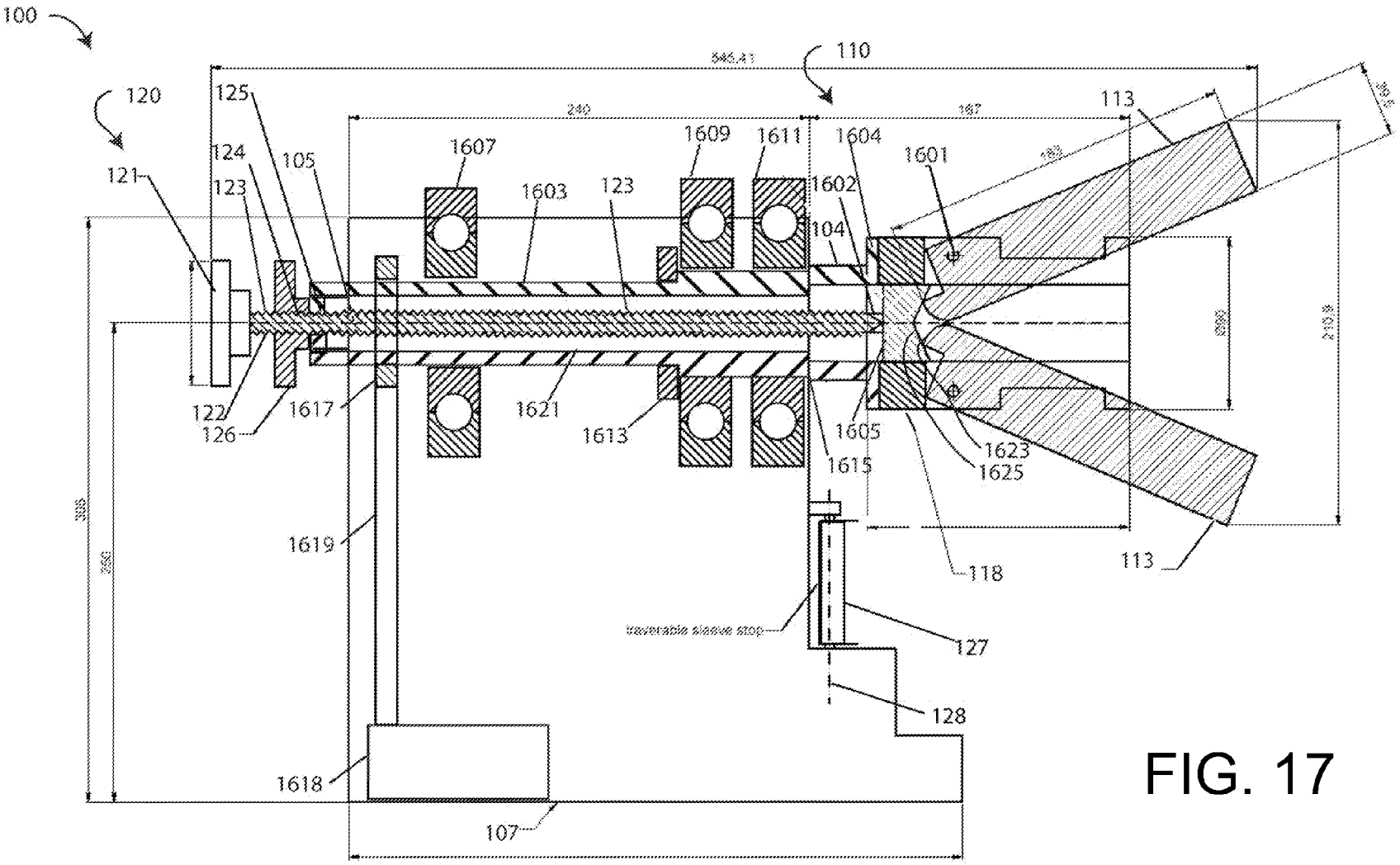
FIG. 17 shows a simplified sectional view 17-17 of FIG. 5B.

The internal structure and operation of device 100 is illustrated by example in FIGS. 16 and 17. FIG. 16 is a simplified sectional view 16-16 of FIG. 1B, showing the device in an open configuration, and FIG. 17 is a simplified sectional view 17-17 of FIG. 5B showing the device in a closed configuration. These figures are not drawn to scale, and some aspects, such as threads, are shown exaggerated. Furthermore, rod 123 is shown in FIGS. 16 and 17 as being threaded throughout the length of rod 123, which in other embodiments, only portions of rod 123 are threaded. Device 100 of FIGS. 16 and 17 is generally the same as device 100 of FIGS. 1-5, except where explicitly stated. For illustrative purposes only, and without limitation, FIGS. 16 and 17 include dimensions, in millimeters, of one embodiment of device 100.

As shown in the embodiment illustrated in FIGS. 16 and 17, device 100 includes hinges 1601, a shaft 104 part of which is shown as 1603, and having: an interior 1621; bearing rest surface 1615 and faceplate 1604; a tapered cam block 1605 having a curved cam surface 1625; bearings 1607, 1609, and 1611; a lock nut 1613; and a belt 1619. Interlock 126 includes a set of inner threads 124, shaft 104 (shaft part 1603) includes a set of inner threads 125, and rod 123 includes threads 122 that match threads 124 and 125. Device 100 also includes an optional stop 127 including a hinge to rotate about axis 128, and an optional pulley 1617 that may be used to rotate the shaft of the device.

Shaft 104 (including shaft part 1603) extends from interlock 126 to faceplate 1604 that is attached to chuck body 118 with screws (not shown). Bearings 1607, 1609, and 1611 are in housings (not shown) that are attached to base body 107 and to shaft 104 to permit the shaft to rotate about axis 105 within the base body. Adjacent bearings 1609 and 1611 restrict axial motion of shaft 104 by being restrained between lock nut 1613, which is threaded into the shaft part 1603 and the change in diameter forming bearing rest surface 1615.

Rod 123 extends from knob 121, is threaded through interlock 126 and through shaft interior 1621. Rod 123 terminates at a conical end 1602 that rests against tapered block 1605. When knob 121 is rotated, rod 123 moves along axis 105, which may also allow tapered block 1605 to move along axis 105.

Each jaw 113 is hinged to chuck body 118 with one of hinges 1601. Each jaw may thus rotate to cause the grip end away from or towards axis 105, with spring 114 providing a restorative force, urging jaw towards axis 105. Cam surface 1625 of tapered block 1605 is in contact with curved back surface 1623 of jaw 113 and rotates the jaws when actuated.

Optional pulley 1617 is attached to shaft 1603, permitting a belt 1619 attached to a motor 1618 to rotate chuck 110 and actuator 120 about axis 105. Pulley 1617 may be, for example and without limitation, be a poly-V pulley for a poly-V belt.

FIGS. 16 and 17 illustrate the effect of rotating knob 121 from one extreme position to another. From the open position of FIG. 16, as knob 121 is rotated, rod 123 rotates and is pushed against tapered block 1605, as forced by springs 114. Surfaces 1623 and 1625 are curved to transfer the force applied from rod 123 to force each of jaws 113 to rotate to cause the respective jaw end of the jaws away from axis 105 and thus close chuck 11. Stop 127 may be rotated between the positions shown in FIGS. 16 and 17, and provide a stand-off distance A for positioning a sleeve on device 100.

Interlock 126 is also threaded into the shaft. When interlock 126 is rotated about rod 123 and against shaft 1603, tension on threads 122, 124, and 125 prevents rod 123 from moving, and thus prevents jaws 113 from returning towards axis 105, restraining the motion of the rod along axis 105.

When knob 121 is rotated to move chuck 110 back from the closed position of FIG. 17 to the open position of FIG. 16, rod 123 rotates and tapered block 1605 moves way from jaws 113. Spring 114 provides a restorative force to move the grip ends of jaws 113 towards the axis, with surface 1623 contacting surface 1625.

Note that the method of interlocking using interlock 126 is only one way of locking the position of rod 121, and other methods of interlocking would be clear to one of ordinary skill in the art, and within the scope of the present invention.

Figure 6:
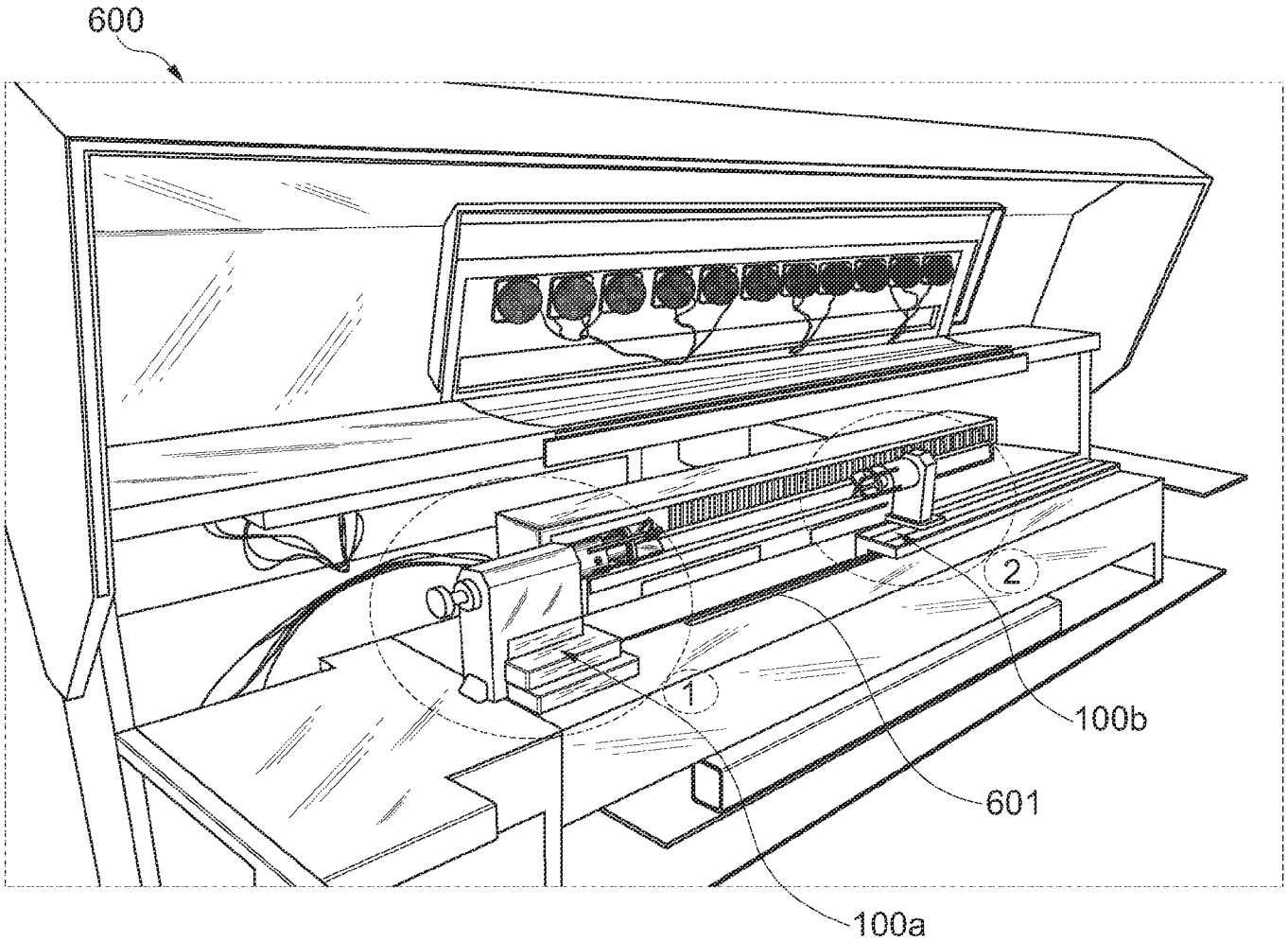
FIG. 6 shows side perspective images of an embodiment of a flexographic UV exposure machine having a first and a second support device for supporting a cylindrical printing sleeve or printing sleeve adapter.

The use of device 100 is described, for illustrative purposes, in the side perspective image of FIG. 6 as an embodiment of a machine 600 for flexographic sleeves. The machine has a first cylindrical printing sleeve or sleeve adapter support device 100*a* and a second cylindrical printing sleeve or sleeve adapter support device 100*b*. In one embodiment, the shaft of one of devices 100*a* and 100*b* includes pulley 1617 for rotating the shaft of the device. At least one of devices 100*a* and 100*b* is slidably mounted on a rail 601, and are otherwise generally similar to device 100, except as explicitly stated. In one embodiment, one device is fixed, and the second device is slidable mounted on a rail 601. When the chucks of each of the two devices hold a sleeve or sleeve adapter, and the shaft of one of the devices includes a pulley with a belt drive to a motor, and the motor used to rotate the pulley, the sleeve/sleeve adapter and both shafts of the devices rotate.

Machine 600 may be, for example and without limitation, a UV exposure unit used in flexographic processing. Thus, for example, a flexographic sleeve is exposed in an exposure unit. The flexographic sleeve, or the flexographic sleeve supported internally by a sleeve adapter, are then transferred into machine 600.

Figure 7:
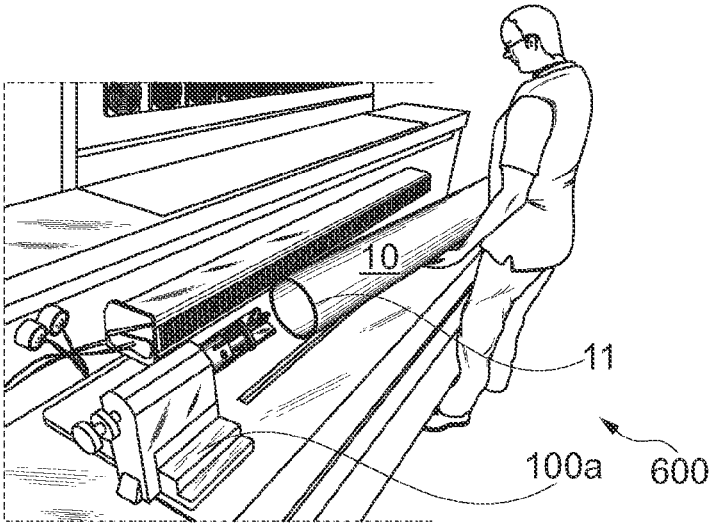
FIGS. 7 to 15 show images of the flexographic UV exposure machine of FIG. 6 illustrating the placement of a sleeve within the machine, where
Figure 8:
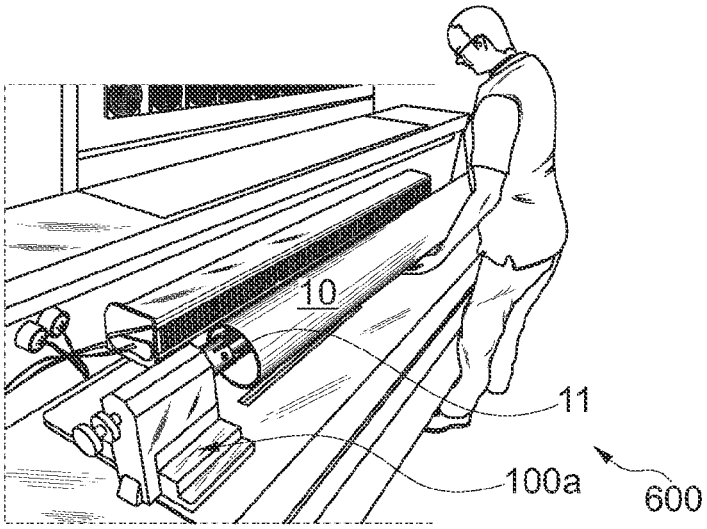
Figure 11:
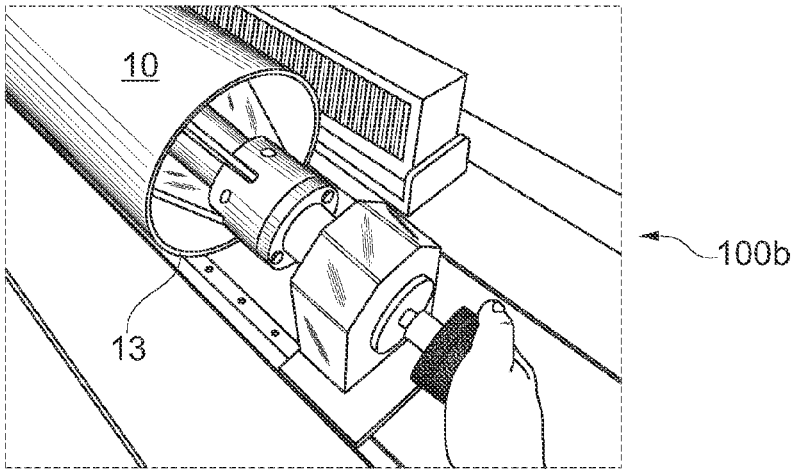
Figure 12:
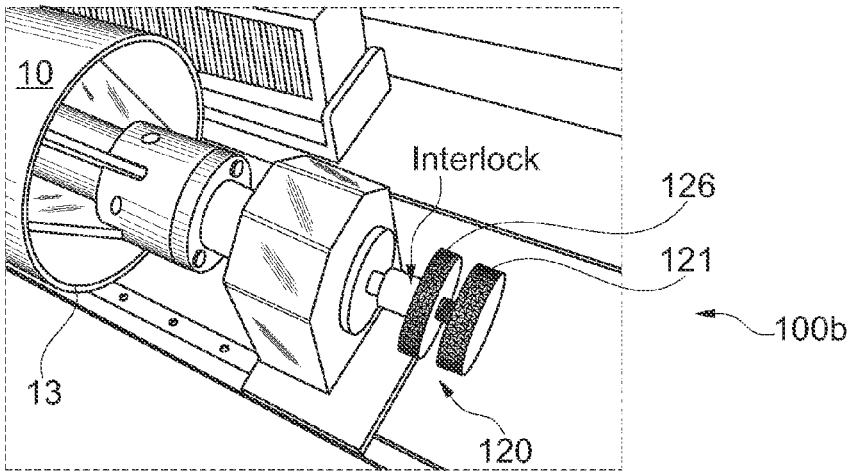
Figure 13:
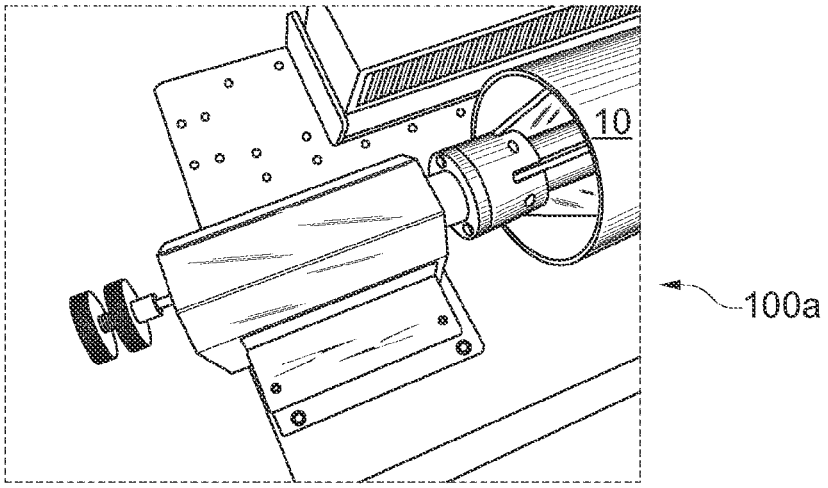
Figure 14:
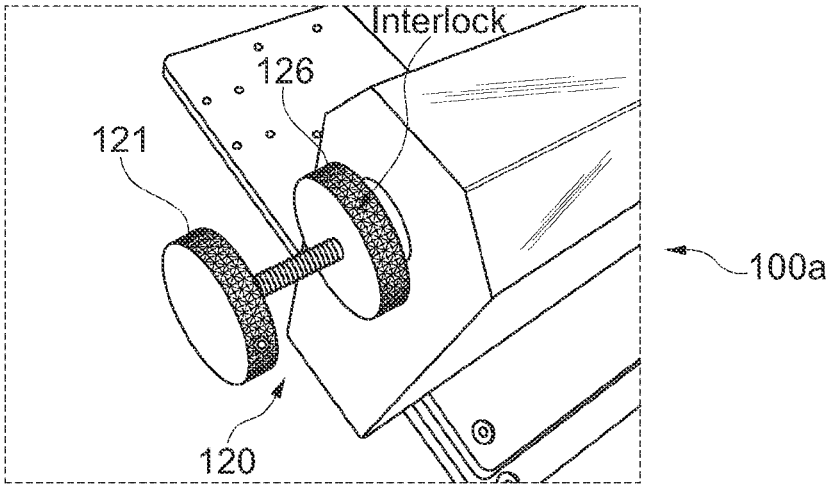
Figure 15:
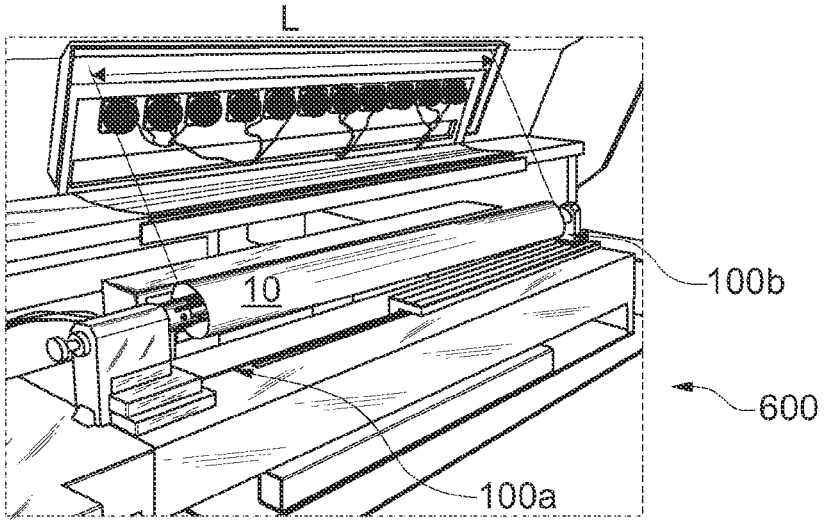

FIGS. 7 to 15 show images of the flexographic processing machine 600 illustrating steps in the placement of a sleeve (or sleeve adapter) 10 having ends 11 and 13. FIGS. 7 and 8 illustrates sequential steps of a user placing sleeve or sleeve adapter 10 into the first device 100*a*, FIGS. 9, 10, 11, and 12 illustrate sequential steps of a user placing and securing a sleeve into the second device 100*b*, FIGS. 13 and 14 illustrate sequential steps of a user securing the sleeve into the first device 100*a;* and FIG. 15 is a image of a sleeve mounted into the flexographic processing machine utilizing the first and second devices. Sleeve (or sleeve adapter) 10 may be removed from machine 600 by reversing the steps of FIGS. 7 to 15.

FIG. 7 illustrates device 100*a* in an open configuration, such as in FIG. 1, and a user placing a sleeve or sleeve adapter between devices 100*a* and 100*b*.

FIG. 8 illustrates the user moving end 11 towards, and then over device 100*a*.

Figure 9:
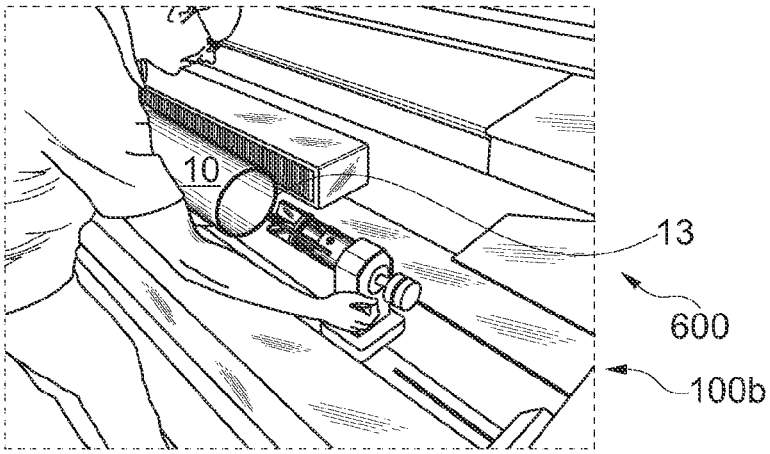

FIG. 9 illustrates the user sliding device 100*b* along rail 601 such that the device moves into end 13.

Figure 10:
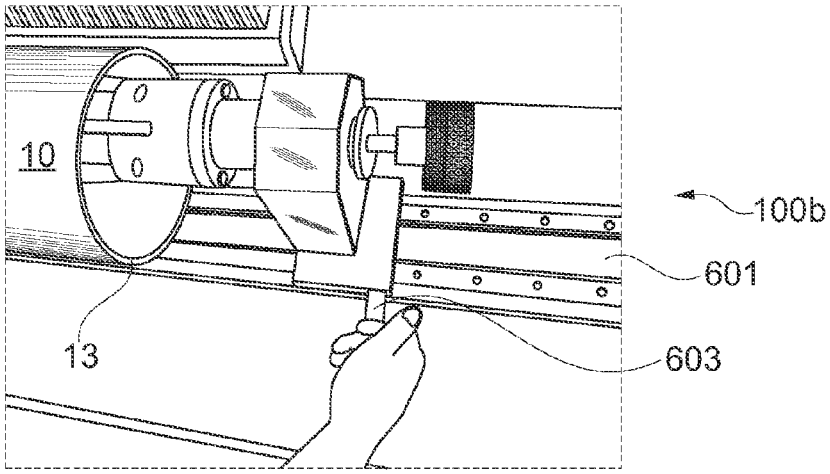

FIG. 10 illustrates the user tightening a knob 603 of device 100*b* that fixes the position of device 100*b* on the rail.

FIG. 11 illustrates the user moving actuator 120 to expand the jaws and tighten the chuck 110 of device 100*b* against an inside surface and end 13.

FIG. 12 illustrates interlock 126 of device 100*b* adjusted to fix the position of the grip ends 109 of jaws 113 of device 100*b* as, for example, in FIGS. 5A and 5B.

FIG. 13 illustrates actuator 120 of device 100*a* adjusted to move the grip ends 109 of jaws 113 against the inside surface of end 11, as, for example, in FIGS. 5A and 5B.

FIG. 14 illustrates interlock 126 of device 100*a* adjusted to fix the position of the grip ends 109 of jaws 113 of device 100*a*.

FIG. 15 shows the sleeve (or sleeve adapter) 10 mounted on devices 100*a* and 100*b* in machine 600. With the sleeve (or sleeve adapter) 10 so mounted, one of device 100*a* or 100*b* may be driven by pulley 1617 to rotate both devices and the sleeve (or sleeve adapter).

In certain embodiments, devices 100*a* and 100*b* are sized to hold sleeve (or sleeve adapter) 10 having a range of lengths. In one embodiment, the range of lengths is any length denoted L of between 1 m to 2 m. In another embodiment, the range of lengths is 1.5 to 2.5 m. Other embodiments may hold a wider range of lengths, while others may hold a narrower range of lengths. Thus for example, and without limitation, for one example sleeve, L may be approximately 2.0 m. In certain other embodiments, devices 100*a* and 100*b* are sized to hold a sleeve or an adapter having an inside diameter of from 89 mm to 300 mm. Other embodiments may hold a wider range of diameters, while others may hold a narrower range of diameters.

Reference throughout this specification to "one embodiment," "an embodiment," and "certain embodiments" means that a particular feature, structure or characteristic described in connection with the embodiment is included in at least one embodiment of the present invention. Thus, appearances of the phrases "in one embodiment," "in an embodiment," or "in certain embodiments" in various places throughout this specification is not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Description of Example Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Any discussion of prior art in this specification should in no way be considered an admission that such prior art is widely known, is publicly known, or forms part of the general knowledge in the field.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, the devices or mechanisms presented are merely representative of devices or mechanisms that may be used. Steps may be added or deleted to methods described within the scope of the present invention.

The invention claimed is:

1. An apparatus for mounting a cylindrical printing sleeve or printing sleeve adapter along the cylinder axis in a housing, the printing sleeve or printing sleeve adapter having a first hollow end having a first cylindrical inner surface with a first inner radius and a second hollow end having a second cylindrical inner surface with a second inner radius, the apparatus comprising:

a first device including a first chuck attached to the housing, the first chuck having a first plurality of jaws each having a grip end, where the first chuck includes a first adjusting mechanism to adjust the radial distance between the axis and the grip ends of all of the first plurality of jaws, where the radial distance is adjustable between a first initial distance that is less than the first inner radius, and a first gripping distance that is equal to the first inner radius; and a second device including a second chuck attached to the housing, the second chuck having a second plurality of jaws each having a grip end, where the second chuck includes a second adjusting mechanism to adjust the radial distance between the axis and the grip ends of the second plurality of jaws, the radial distance being adjustable between a second initial distance that is less than the second inner radius, and a second gripping distance that is equal to the second inner radius, where the first plurality of jaws and the second plurality of jaws are spaced to accept the first hollow end and the second hollow end, respectively, such that when the grip ends of the first chuck and the second chuck are adjusted to the first initial distance and second initial distance, respectively, and the first plurality of jaws and the second plurality of jaws are positioned in the first and second hollow ends, respectively, the first chuck and the second chuck are adjustable to move the respective grip ends to the first gripping distance and second gripping distance, respectively, such that the printing sleeve or printing sleeve adapter is mounted within the housing.

2. The apparatus recited in claim 1, wherein the first chuck and the first chuck are rotatably attached to the housing, such that a mounted printing sleeve or printing sleeve adapter may rotate about the axis.

3. The apparatus recited in claim 1, further including a pulley attached to the first chuck or the second chuck, such that a belt attached to the pulley and to a motor causes the first chuck or second to rotate when motor is operated.

4. The apparatus recited in claim 2, wherein at least one of the first device or the second device is movably attached to the housing to move parallel to the axis.

5. The apparatus recited in claim 1, wherein the printing sleeve or printing sleeve adapter has a diameter of between 89 mm and 300 mm.

6. The apparatus recited in claim 1, wherein the printing sleeve or printing sleeve adapter has a length of between 1 m and 2 m.

7. The apparatus recited in claim 1, wherein the first plurality of jaws is 5 jaws.

8. The apparatus recited in claim 1, wherein the first chuck includes a first chuck body, and where each of the first plurality of jaws is hinged to the first chuck body to rotate in a direction perpendicular to the axis to move the grip ends of the first plurality in a radial directions away from or towards the axis.

9. The apparatus recited in claim 8, wherein the first device includes a first actuator operably connected to the first plurality of jaws.

10. The apparatus recited in claim 9, wherein the first actuator includes a first threaded rod and a first cam in contact with the first plurality of jaws, such that when the first threaded rod is rotated, the first cam causes the grip ends of the first plurality of jaws to move towards or away from the axis.

11. The apparatus recited in claim 8, wherein the second chuck includes a second chuck body, and where each of the second plurality of jaws is hinged to the second chuck body to rotate in a direction perpendicular to the axis, wherein the second device includes a second actuator operably connected to the second plurality of jaws, wherein the second actuator includes a second threaded rod and a second cam in contact with the second plurality of jaws, such that when the second threaded rod is rotated, the second cam causes the grip ends of the second plurality of jaws to move towards or away from the axis.

12. The apparatus of claim 1, wherein the first inner radius is equal to the second inner radius.

13. A method of mounting a cylindrical printing sleeve or printing sleeve adapter supporting a sleeve, the sleeve or sleeve adapter having an axis and a length within a housing of a flexographic processing machine, the sleeve or printing sleeve adapter further having a first hollow end having a first cylindrical inner surface with a first inner radius along the axis in the housing, and a second hollow end having a second cylindrical inner surface with a second inner radius along the axis, the method comprising:

restraining the printing sleeve or printing sleeve adapter by:

placing the first hollow end of the sleeve or of the sleeve adapter supporting the sleeve, over a first device including a first chuck attached to the housing, the first chuck having a first plurality of jaws each having a grip end, the first chuck including a first adjusting mechanism to adjust the radial distance between the axis to the grip ends of the first plurality of jaws, the radial distance being adjustable between a first initial distance from the axis that is less than the first inner radius, and a first gripping distance from the axis, the first gripping distance being equal to the first inner radius;

expanding the first chuck using the first adjusting mechanism to cause the grip ends of the first plurality of jaws to extend radially away from the axis to the first gripping distance to grip by friction the first inner surface of the first hollow end of the sleeve, or of the sleeve adapter supporting the sleeve;

placing the second hollow end of the sleeve or sleeve adapter over a second device including a second chuck, the second chuck having a second plurality of jaws each having a grip end, the second chuck including a second adjusting mechanism to adjust the radial distance between the axis to the grip ends of the second plurality of jaws, the radial distance being adjustable between second initial distance from the axis that is less than the second inner radius, and a second gripping distance from the axis that is equal to the second inner radius; and expanding the second chuck using the second adjusting mechanism to cause the grip ends of the second plurality of jaws to extend radially away from the axis to the second gripping distance to grip by friction the second inner surface of the second hollow end of the sleeve the sleeve adapter supporting the sleeve.

14. The method recited in claim 13, further comprising moving the first chuck or the second chuck to accept the length of the sleeve or sleeve adapter supporting the sleeve.

15. The method recited in claim 13, further comprising rotating one or both of the first chuck and the second chuck to accept the length of the sleeve or sleeve adapter supporting the sleeve.

16. The method recited in claim 13, further comprising exposing the sleeve to UV radiation.

17. The method recited in claim 13, wherein the sleeve, or the adapter supporting the sleeve, has a diameter of between 89 mm and 300 mm

18. The method recited in claim 13, wherein the sleeve, or the adapter supporting the sleeve, has a length of between 1 m and 2 m.

19. The method recited in claim 13, wherein the first chuck includes a first chuck body, and where each of the first plurality of jaws is hinged to the first chuck body to rotate in a direction perpendicular to the axis to move the grip ends of the first plurality in a radial directions away from or towards the axis.

20. The method recited in claim 19, wherein the first device includes a first actuator operably connected to the first plurality of jaws.

21. The method recited in claim 20, wherein the first actuator includes a first threaded rod and a first cam in contact with the first plurality of jaws, such that when the first threaded rod is rotated, the first cam causes the grip ends of the first plurality of jaws to move towards or away from the axis.

22. The apparatus recited in claim 19, wherein the second chuck includes a second chuck body, and where each of the second plurality of jaws is hinged to the second chuck body to rotate in a direction perpendicular to the axis, wherein the second device includes a second actuator operably connected to the second plurality of jaws, wherein the second actuator includes a second threaded rod and a second cam in contact with the second plurality of jaws, such that when the second threaded rod is rotated, the second cam causes the grip ends of the second plurality of jaws to move towards or away from the axis.

23. The method of claim 13, wherein the first inner radius is equal to the second inner radius.

* * * * *